US008398462B2

(12) United States Patent
Sung

(10) Patent No.: US 8,398,462 B2
(45) Date of Patent: Mar. 19, 2013

(54) CMP PADS AND METHOD OF CREATING VOIDS IN-SITU THEREIN

(76) Inventor: Chien-Min Sung, Taipei County (TW)

( * ) Notice: Subject to any disclaimer, the term of this patent is extended or adjusted under 35 U.S.C. 154(b) by 812 days.

(21) Appl. No.: 12/389,922

(22) Filed: Feb. 20, 2009

(65) Prior Publication Data

US 2009/0215363 A1 Aug. 27, 2009

Related U.S. Application Data

(60) Provisional application No. 61/030,501, filed on Feb. 21, 2008.

(51) Int. Cl.
*C09K 3/14* (2006.01)
*B24B 1/00* (2006.01)

(52) U.S. Cl. ..... 451/56; 451/527; 51/300

(58) Field of Classification Search ..... 451/56, 451/526–539; 51/296, 300, 306, 307
See application file for complete search history.

(56) References Cited

U.S. PATENT DOCUMENTS

| | | | | |
|---|---|---|---|---|
| 3,183,633 | A * | 5/1965 | Decker | 451/541 |
| 3,353,994 | A * | 11/1967 | Welsh et al. | 521/52 |
| 4,128,972 | A * | 12/1978 | Charvat | 51/298 |
| 7,972,397 | B2 * | 7/2011 | Vail | 51/295 |
| 2005/0227590 | A1 * | 10/2005 | Sung | 451/41 |
| 2006/0151336 | A1 | 7/2006 | Butterfield et al. | |

FOREIGN PATENT DOCUMENTS

| | | |
|---|---|---|
| EP | 1 600 260 | 11/2005 |
| EP | 1 637 281 | 3/2006 |
| WO | WO 2007/137033 | 11/2007 |

* cited by examiner

*Primary Examiner* — Maurina Rachuba
(74) *Attorney, Agent, or Firm* — Thorpe North & Western LLP

(57) ABSTRACT

A method of creating pores in a CMP pad in-situ includes impregnating a first material with a second material to form a CMP pad. The second material can have a resistance to frictional erosion that is less than that of the first material. The CMP pad thus has two materials with differing frictional erosion resistances. The working surface of the CMP pad can be contacted to a wafer to be polished wherein the second material can be frictionally eroded during polishing.

20 Claims, No Drawings

CMP PADS AND METHOD OF CREATING VOIDS IN-SITU THEREIN

PRIORITY DATA

This application claims the benefit of U.S. Provisional Patent Application Ser. No. 61/030,501, filed on Feb. 21, 2008, which is incorporated herein by reference.

BACKGROUND OF THE INVENTION

Chemical mechanical polishing, or CMP, is a method often utilized to polish wafers of ceramics, silicon, glass, quartz, and metals. CMP pads have a working surface, used to contact the object to be polished, that has a large number of small asperities. CMP generally involves applying the object to be polished, e.g. a wafer, against a rotating porous pad having asperities that is made from a durable organic substance. A chemical slurry is utilized that contains a chemical capable of breaking down the wafer substance and an amount of abrasive particles which act to physically erode the wafer surface. The mechanical aspect of polishing occurs from abrasive particles, typically included in the chemical slurry, and the chemical aspect of polishing is generally oxidation that occurs of metal to ease in mechanical removal. The slurry is continually added to the rotating CMP pad, and the dual chemical and mechanical forces exerted on the wafer cause it to be polished in a desired manner.

Many CMP pads are made of porous urethane. Often, such CMP pads include about ⅓ by volume pores. During processing, the pores interact with the chemical slurry and abrasive particles to retain them on the working surface of the CMP pad. Ideally, the porous structure of a CMP pad works to effectively retain at least a portion of the chemical slurry. Unfortunately, many designs cause slurry leak through the pad due to the construction of the pores of the CMP pad.

As semiconductor technology continues toward size reduction to the nano-scale, however, current CMP polishing techniques are proving to be inadequate. With such a reduction in scale, materials utilized to construct circuit elements have become more delicate, both in size and materials. The CMP industry has been required to respond by providing polishing materials and techniques that accommodate these advances. For example, lower CMP polishing pressures, smaller size abrasive particles in the slurry, and polishing pads of a size and nature that do not over polish or damage the wafer must be used. Furthermore, proper distribution of slurry is needed to prevent heat damage to the material of the CMP pad, to provide proper chemical polishing, and to provide proper mechanical polishing due to the abrasive particles.

SUMMARY OF THE INVENTION

Accordingly, the present invention provides polishing tools, methods of making, and methods of use. Particularly, the present disclosure is related to creating pores in a CMP pad in-situ during the polishing of a workpiece.

In one aspect, a method of creating pores in a CMP pad in-situ can include impregnating a first material with a second material to form a CMP pad. The second material can have a resistance to frictional erosion that is less than that of the first material. The CMP pad thus has two materials with differing frictional erosion resistances. The working surface of the CMP pad can be contacted to a wafer to be polished and as the polishing ensues the second material can be frictionally eroded due to the frictional forces created by the action of the pad against the wafer.

The present invention further encompasses tools for polishing a wafer. In some aspects, such tools may include a first material suitable for forming a CMP pad and having a first resistance to frictional erosion, said first material forming a portion of the CMP pad, and a second material dispersed in the first material, said second material having a second resistance to frictional erosion that is less than that of the first material and configured to selectively erode based on differing resistance to frictional erosion, upon frictional contact with the wafer such that the erosion leaves effective pore voids in the solid substrate.

In further aspects of the present invention, such tools may be a CMP pad and may include polyurethane formed into a CMP pad and from about 0.1 vol % to about 20 vol % graphite having a high degree of graphitization dispersed in the polyurethane of the CMP pad and configured to selectively erode upon frictional contact with the wafer such that the erosion forms effective pore voids in the solid substrate.

In yet additional aspects of the present invention, there is provided methods of lubricating a CMP pad during a CMP event. Such methods may include impregnating a first material having a first resistance to frictional erosion with a second material having resistance to frictional erosion that is less than that of the first material to form a CMP pad having two materials with different frictional erosion resistances, said second material configured to act as a lubricant upon erosion, contacting a working surface of the CMP pad to a wafer to be polished; and frictionally eroding the second material during the polishing process by operating the pad against the wafer.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Reference will now be made to the exemplary embodiments, and specific language will be used herein to describe the same. It will nevertheless be understood that no limitation of the scope of the invention is thereby intended. Alterations and further modifications of the inventive features, process steps, and materials illustrated herein, and additional applications of the principles of the inventions as illustrated herein, which would occur to one skilled in the relevant art and having possession of this disclosure, are to be considered within the scope of the invention. It should also be understood that terminology employed herein is used for the purpose of describing particular embodiments only and is not intended to be limiting.

DEFINITIONS

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the fluid" includes reference to one or more of such fluids.

As used herein, the term "configured to" refers to the purposeful selection, placement and/or design to effectuate a predetermined function or purpose. Therefore, configuring something to do something requires first, an identified objective or purpose, and second, selection and designing to reach the purpose or objective. As such, qualities resulting from manufacture without a predetermined (i.e. determined prior to manufacture) objective or purpose are not considered to result from "configured to" designs.

"Agglomerates" is a term used herein to refer to a discrete collection of a particulate material. Typically, agglomerates are a limited number of associated particles of a material. Although any size of agglomerate is possible that meets the other aspects of the present disclosure, agglomerates are generally of a size order of less than about 1000 microns in size, and more typically are less than about 500 microns in size.

As used herein, "wafer" refers to an object that can be polished by chemical mechanical polishing. As such, the term is consistent with industry meaning, and can include a silicon substrate optionally having wiring or electrodes formed thereon, in some cases by prior chemical etchants. In some aspects, however, the definition of wafer may be expanded to include non-silicon based materials, such as ceramics, silicon, glass, quartz, and metals, which may be compatible with a CMP polishing system.

As used herein, "working surface" refers to a surface of a polishing tool that is brought into contact with a surface to be polished during polishing processes. In general, the working surface can include asperities useful in polishing. Often, chemical polishing agent can be utilized in CMP processes, at which time, the chemical polishing agent is generally deposited on at least a portion of the working surface of a CMP pad.

As used herein, "impregnate" and "impregnated" refers to a first material having a second material introduced into it, or the act of introducing such. For example, "graphite impregnated" indicates a material having graphite admixed or combined therein. In some aspects, the graphite may occupy voids or spaces within the impregnated material. In other aspects, the graphite material can be present as discrete particles, strands, or masses in continuous contact with the first material and often being completely surrounded thereby, thus forming a substantially solid pad. By way of example without limitation, a first material may become impregnated with a second material by providing, for example, a first material as a powder. The first powder material is then mixed with particles of the second material, such as graphite, and melted to form a mixture. The mixture can then be further processed to a CMP pad (solid or including an amount of voids) containing second material (i.e. graphite) particles. The product of such process is considered to be a graphite impregnated CMP pad. Furthermore, a graphite impregnated CMP pad may have graphite dispersed evenly throughout the CMP pad, or may be unevenly dispersed. In some aspects, the even dispersion may be patterned according to a predetermined pattern or design. Such patterning can exist both two dimensionally along discrete layers and also be three dimensional throughout a portion of, or the entire thickness of the pad. The graphite may be present throughout the entire CMP pad, but randomly dispersed. Additionally, the graphite may be present only in the working surface of the CMP pad. Furthermore, the graphite may have higher concentration towards the working surface of the CMP pad or other patterns of particle gradation.

As used herein, "degree of graphitization" refers to the proportion of graphite that has graphene planes having a theoretical spacing of 3.354 angstroms. Thus, a degree of graphitization of 1 indicates that 100% of the graphite has a basal plane separation ($d_{(0002)}$) of graphene planes, i.e. with hexagonal network of carbon atoms, of 3.354 angstroms. A higher degree of graphitization indicates smaller spacing of graphene planes. The degree of graphitization, G, can be calculated using Equation 1.

$$G=(3.440-d_{(0002)})/(3.440-3.354) \quad (1)$$

Conversely, $d_{(0002)}$ can be calculated based on G using Equation 2.

$$d_{(0002)}=3.354+0.086(1-G) \quad (2)$$

Referring to Equation 1, 3.440 angstroms is the spacing of basal planes for amorphous carbon ($L_c$=50 Å), while 3.354 angstroms is the spacing of pure graphite ($L_c$=1000 Å) that may be achievable by sintering graphitizable carbon at 3000° C. for extended periods of time, e.g., 12 hours. A higher degree of graphitization corresponds to larger crystallite sizes, which are characterized by the size of the basal planes ($L_a$) and size of stacking layers ($L_c$). Note that the size parameters are inversely related to the spacing of basal planes. A "high degree of graphitization" can depend on the materials used, but typically indicates a degree of graphitization equal to or greater than about 0.8. In some embodiments, a high degree of graphitization can indicate a degree of graphitization greater than about 0.85, 0.9, or even 0.95.

Graphite is available in a wide variety of grades and forms such as amorphous, crystalline, and synthetic graphite. Table 1 shows crystallite properties for several common grades of graphite.

TABLE 1

| Graphite Type | $d_{(002)}$ | $L_a$ (Å) | $L_c$ (Å) | $I_{112}/I_{110}$ |
|---|---|---|---|---|
| Pure Natural | 3.355 | 1250 | 375 | 1.3 |
| Low Temp (2800° C.) | 3.359 | 645 | 227 | 1.0 |
| Electrode | 3.360 | 509 | 184 | 1.0 |
| Spectroscopic | 3.362 | 475 | 145 | 0.6 |
| High Temp (3000° C.) | 3.368 | | 400 | 0.9 |
| Low Ash | 3.380 | 601 | 180 | 0.8 |
| Poor Natural | 3.43 | 98 | 44 | 0.5 |

Further, Table 2 illustrates the anisotropic properties of graphite.

TABLE 2

| Graphite anisotropy | Thermal Conductivity (W/mK) | Thermal Expansion (ppm/K) |
|---|---|---|
| // to basal planes | 1950 | 0.5 |
| ⊥ to basal planes | 5.7 | 27 |

As used herein, "substantially" refers to situations close to and including 100%. Substantially is used to indicate that, though 100% is desirable, a small deviation therefrom is acceptable. For example, substantially all asperities includes groups of all asperities and groups of all asperities minus a relatively small portion of asperities.

"Polishing event" refers to a discrete portion of or an entire polishing process, wherein a single object is polished via CMP. Therefore, any amount of time wherein the working surface of a CMP pad is in contact with a surface to be polished and is moving in a direction substantially parallel to the surface to be polished is considered a polishing event.

As used herein, "liquid polishing agent" refers to any liquid utilized along the working surface of a CMP pad during polishing, and includes, without limitation, water, chemical slurries having particulates, acids, and combinations thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

As noted previously, the demand for improved CMP processes is expected to rise to keep pace with the evolving technology. The inventor has discovered that materials can be included in a CMP pad with the intention that use of the CMP pad will naturally erode a portion of the material, which can provide one or more benefits to the CMP process.

Porous structures in a CMP pad can assist in CMP polishing processes in a variety of ways. Without being bound by any particular theory, it is thought that pores along or near a working surface of a CMP pad can provide a void into which liquid polishing agent or slurry can be better retained on or along the working surface as opposed to being forced off of the surface due to centrifugal force typically present in CMP polishing. The retention of the liquid polishing agent or slurry improves the chemical portion of the CMP, or chemical mechanical polishing process.

Typically, though, loss of CMP pad material during processing was a source of pad failure, or process failure in that the debris could remain on the working surface of the CMP pad and would scratch the surface to be polished, i.e. of a wafer, or the altered portion of the CMP pad would fail to properly polish. Such scratching is unacceptable and would result in scrapping or at least re-working the wafer and/or the CMP pad, which can result in higher costs and loss of processing time and efficiency. As such, porous pads can be intentionally formed into porous bodies prior to use. As noted previously, however, such porous bodies typically do not service the CMP processing as would be desired, in that many of the pore structures are interconnected and provide a means whereby liquid chemical polishing agent may be removed from the working surface of the CMP pad.

Through use of the CMP pads and associated methods disclosed herein, however, pores can be created in a CMP pad in-situ. Such can occur during a polishing event or process, and the pores created can optionally be discrete, wherein liquid may be retained while preventing liquid from leaking through the pad. It is believed that the formation of such pores or voids during processing conditions can provide added benefits to CMP pad processing and CMP polishing. Furthermore, depending on the depth of the pores and the composition of the CMP pad, liquid retained in the pores may be forced to the working surface by the pressure caused by the contact of the working surface of the CMP pad to a wafer.

A method of creating pores in a CMP pad in-situ during a CMP polishing event can include impregnating a first material with a second material to form a CMP pad. Each material has a resistance to frictional erosion (for ease of discussion, a first resistance to frictional erosion for the first material, and a second resistance to frictional erosion for the second material). The second resistance to frictional erosion is less than that of the first material. Thus, the combination of materials forms a CMP pad having two materials having different frictional erosion differences. The method can further include contacting a working surface of the CMP pad to a surface to be polished, such as a wafer surface. The second material can be frictionally eroded during the polishing process by operating the pad against the wafer. As such, the second material can be eroded at a faster rate than the first material due to the friction caused by the CMP polishing process, thus effectively opening up pores in the first material as the second material erodes. As such, the second material can be used to reserve pore size and location in the first material.

In some instances, the presence of the second material having a lower resistance to frictional erosion than that of a first material in a CMP pad, even with little to no erosion from polishing, can provide benefits to the CMP pad. It is thought that pores, besides providing locations for reservoirs of liquid polishing solution, allow the contact pressure of asperities surrounded by the second material to be increased during polishing without detrimental effects. Materials having a lower resistance to frictional erosion are often, although not necessarily, softer materials, which can reduce the contact pressure at the location of the second material, similar to when the asperity is surrounded by pores. The yielding of softer material such as, e.g., graphite, due to compression or sliding, requires nearby asperities of the CMP pad to support a greater load of the force of polishing. As such, pressure is more concentrated at the asperities. Such concentration causes the abrasive particles perched on the asperities to press harder into the wafer. According to the Prestone equation, the removal rate of material is directly proportional to the contact pressure. Therefore, presence of a softer material effectively increases the contact pressure in the asperities with results in a faster or higher removal rate. In this manner, a second material may function as an effective pore.

However, where the second material is softer and/or functions as an effective pore, an over-abundance of the second material can be detrimental or at least reduce the effectiveness of the CMP pad. Such overabundance is likely to result in the wafer gliding on the pad without polishing or with reduced polishing due to lubrication, such as with an overabundance with, e.g., graphite. As such, the concentrations and relative amounts of the first material to the second material can be optimized to result in improved and/or faster removal rates. Such optimization, in one aspect, can include optimizing the general concentrations throughout the life of the CMP pad, and therefore, progressive erosion of the second material. In one aspect, the finer the second material flakes, such as, e.g., less than about 20 microns, or about 5 microns to about 15 microns, or about 10 microns, the smaller volume percent may be needed for optimization. Further, the relative softness of the first material can be considered in optimization, where a softer first material may be optimized with a lower concentration of second material.

By adjusting the contact pressure of asperities of the CMP pad, the pressure required to break or otherwise damage the wafer (e.g., by scratching or breaking of the IC layer of copper or oxide) is reduced. In other words, the asperities of a CMP pad may encounter an uneven force distribution, as may be affected by, e.g., uneven asperities, asperity shape and orientation, etc. The asperities or areas of the CMP pad experiencing greater amounts of force, or those protruding from the working surface of the CMP pad are more likely to fail (i.e. break or become damaged and, in turn, damage a wafer during polishing or fail to polish a portion of a wafer), or may scratch a wafer. In such cases, CMP pads including a second material may effectively assist the CMP pad in redistributing forces experienced by individual asperities to prevent such failure and/or scratching.

Additionally, some material combinations may include a more hydroscopic second material, compared to properties of the first material. In such cases, the second material may be configured to effectively retain liquid polishing solution in certain areas or arrangements on or near the working surface of the CMP pad.

The second material of the CMP pad can be frictionally eroded during a polishing event. Such erosion is not dissolution of a second material, but is consistent with the plain meaning of erosion in that substantially solid matter is displaced. It should be noted, however, that optionally and in one aspect, a portion of the second material may dissolve in a liquid polishing agent after and/or upon frictional erosion.

The second material is frictionally eroded by a polishing event or events, to produce displaced amounts of the second material, and effective pores or voids in the CMP pad surface. In one aspect, the erosion occurs substantially along the working surface of the CMP pad. Such erosion forms pores or voids which can assist the working surface of the CMP pad in retaining liquid polishing agent, similarly to the functioning of conventional pores in polyurethane pads.

A variety of materials can be utilized in the CMP pads. The first material need be appropriate for use in a CMP pad and the second material needs a resistance to frictional erosion that is less than that of the first material and should be compatible with impregnation into the first material. Optionally, a CMP pad can include additional additives, distributed throughout the body of the pad and/or concentrated in areas or in defined regions of the pad. In one aspect, such CMP pad can be or include a solid substrate, having substantially no pores prior to use in polishing. In another aspect, the CMP pad can include a number of voids in the body and/or on or near the working surface, both naturally occurring and/or machined voids.

In one aspect, various polymers can be included in the CMP pad as one or both of the first or second materials. Such polymers can optionally include cross-linking. Non-limiting examples include biopolymers, conductive polymers, fluoropolymers, inorganic polymers, phenolic resins, polyanhydrides, rubbers, silicones, polyolefins, thermoplastic resins, curable resins, mixtures and combinations thereof. Further, additional non-limiting examples of polymers that may be used include: polyurethane, polyamides, polyimides, nylon polymer, polyester, diene containing polymers, acrylic polymers, polyethylene, polypropylene, polystyrene, polyethylene terephthalate, polyamide, polyvinylchloride, polycarbonate, acrylonitrile butadiene styrene, polyvinyldiene chloride, polytetrafluoroethylene, polymethyl methacrylate, polyacetylene, ethylene-propylene-diene-methylene, and combinations thereof. In one embodiment, the first material of the CMP pad comprises polyurethane. In another embodiment, the first material of the CMP pad and the second material of the CMP pad can be different polymers. In one aspect, a polymeric material may be useful in forming the CMP pad in that it can more easily be formed into the desired shape of a CMP pad.

The first and/or second materials can be selected from non-polymeric materials such as, e.g., ceramics and metals. Non-limiting examples of materials which may be used as one of the materials or an optional additive of the CMP pad include: carbon allotropes including graphite and diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, Al, Cu, Zn, Ga, In, Sn, Ge, Pb, Tl, Cd, Ag, Au, Ni, Pd, Pt, Co, Fe, Mn, W, Mo, Cr, Ta, Nb, V, Sr, Ti, Si, and combinations thereof. Additional materials could be used in the formation of a CMP pad configured to form pores in-situ.

Furthermore, such materials as those listed as potential first and/or second materials can be used as optional additives. More than one additive could be used, and their selection and inclusion would be within the purview of one of ordinary skill in the art. Such additives could be included to modify the properties substrate. The additives could be included to alter the conductive or mechanical polishing properties of the solid substrate.

The CMP pads, as disclosed herein, can optionally include abrasive particles. Such abrasive particles can optionally consist or comprise of ceramic particles, superabrasive particles, nano-abrasive particles, nano-superabrasive particles, and combinations or mixtures thereof. Non-limiting examples of superabrasive particles include diamond and cubic boron nitride. Non-limiting examples of ceramic particles include alumina and silica particles. Addition of abrasive particles, as with addition of any additive to the CMP pad material, can according to methods known in the art, and may include, without limitation, pre-coating and the use of coupling agents. Where abrasive particles are included in the CMP pad, the liquid polishing agent may optionally consist of water. Additionally or alternatively, abrasive particles can be included in the liquid polishing agent. Further, additionally or alternatively to inclusion of abrasive particles, carbon nanotubes (CNT) can be included in the make-up of the CMP pad. Such distribution of CNT can be of any method and any pattern arrangement or non-pattern as desired. Inclusion of CNT may be particularly desired when polishing soft copper or porous dielectric material on wafers.

As noted, in one aspect, a first material, second material or optional additive can comprise or consist of a carbon allotrope. Carbon allotropes demonstrate a variety of material properties, and particularly demonstrate a wide range of resistance to frictional erosion. As such, the selection of a carbon allotrope is dependent on a variety of factors, and such selection would be within the purview of one skilled in the art. Non-limiting examples of carbon allotropes that may be useful in the present invention include graphite (of any degree of graphitization), amorphous carbon, diamond, fullerenes, carbon nanotubes, aggregated diamond nanorods, glassy carbon, carbon nanoform, lonsdaleite, chaoite, and combinations thereof. Additionally, other forms of carbon may be useful in the present invention. Non-limiting examples include graphite powder, graphite flakes, graphite fibers, purified carbon of any form, carbon fibers, carbon powder, carbon black. It is possible that both the first and the second materials are selected from different carbon allotropes.

In one aspect, graphite can be utilized as the second material. The graphite can be in any form capable of being impregnated or otherwise dispersed in a first material to form a CMP pad, such as, without limitation, particles, chunks, flakes, and combinations thereof, as well as nearly any other discrete mass of a particular or predetermined shape. In one embodiment, at least a portion or substantially all of the graphite can be graphite having a high degree of graphitization. Graphite having a high degree of graphitization is a soft material, having a relatively low resistance to frictional erosion, that is inert and acid proof. This type of graphite is generally chemically resilient to the chemicals and materials that are used in CMP processing. In one aspect, the degree of graphitization of the graphite can be greater than about 0.80. In a further aspect, the degree of graphitization of the graphite can be about 0.90, or even greater than about 0.95. Furthermore, graphite does not adhere to copper or oxide, materials often present on a wafer in CMP polishing. As such, cleaning graphite from a wafer would be minimal to non-existent. Additionally, graphite would not corrode IC of wafers due to the general chemical inert nature of graphite.

In one aspect, a CMP pad dresser can form the asperities on the CMP pad during in-situ use, or as a preconditioning step. Likewise, other tools or mechanisms can be used to form the asperities on the CMP pad when performed in a preconditioning manner. In many cases, the texture of the pad dictates the parameters for management and retention of the slurry applied to it. For example, pads having a fine texture are better able to wet (i.e. engage and hold or even absorb) slurry with a smaller contact angle and with more rapid and even spreading of the slurry across the pad surface due to the larger capillary force produced by the larger contact and/or surface area (i.e. denser asperities). Such fine textures may be produced when the pad is dressed by machined diamond disks as compared to brazed diamond disks. Furthermore, the incorporation of graphite and other similar additives, can work to further enhance this difference, and thus improve retention, spreading and disbursement, and wetting of liquid slurry on the pad. In fact, in many cases the contact angle of water droplets on CMP pads shows that pads including graphite are able to engage and absorb (i.e. wet) water and other aqueous liquids much more readily than those without graphite. It is believed that such properties of a graphite-including CMP pad are due to the ability of graphite to engage and interact with (i.e. wet) water at the molecular level. In other words, the graphite in the pad renders the pad more hydrophilic than hydrophobic. By contrast, most polymers used to make CMP pads typically provide a rather hydrophobic product, which to varying extents repel aqueous-based slurry, thus contributing to slurry run-off during use. As such, the CMP pads of the present invention provide the distinct advantage of better wetting of liquid polishing materials and slurries, particularly aqueous based materials, through their graphite content as well as the contact angles provided by their surface textures.

The contact time between the wafer and the CMP pad during a polishing operation is actually quite brief due to the fast relative speeds of both articles in the process. The slurry at the contact points can be removed during polishing. However, these contact points are still on high positions and subsequent polishing at these points without slurry creates a significant amount of local, and eventually global heat. However, with graphite particles included in the CMP pad, slurry is better held and can migrate to cover the contact points throughout polishing, as graphite improves the CMP pad's ability to retain slurry both generally, and locally. The lubrication effect of the graphite also acts to avoid heat-only producing encounters with contact points. As previously noted, the eroded graphite leaves pores that can increase the contact pressure of nearby asperities, in addition to providing a reservoir for the slurry.

Graphite can absorb and hold a significant amount of water in some respects due to the presence of dangling (i.e. unpaired) electrons on the graphene planes. The grain boundaries are particularly active. They can absorb readily almost any radical. The graphite used in the present invention can be highly purified, typically by chlorine gas. Chlorine termination on the surface of graphite can increase the hydrophobicity of the graphite, thus allowing for easier dispersion in CMP polymeric mediums (e.g., polyurethane). If the dispersion is not effective, graphite can be heated (e.g. to about 800° C. to about 1000° C.) under hydrogen atmosphere to form hydrogen termination that is hydrophobic. If fluorine is used to terminate the surface, the nature of the C—F bonds can make graphite the more hydrophobic. Alternatively, if N, O, or OH bonds are included, graphite would be hydrophilic. In most cases, graphite is both hydrophobic with H, F, Cl, $CH_3$ termination, and also hydrophilic with N, O, OH, $NH_3$, S, and $SO_3$ terminations. A number of such variations and treatment process can be used to more effectively mix and place graphite with various polymer materials as a planned step in the pad production process, and can be dictated in part by the properties of the polymer materials to be used.

In one non-limiting example, the first material can consist of polyurethane and the second material can consist of graphite. As such, a polyurethane material can be impregnated with graphite to form a CMP pad. The graphite can be of any form configured to frictionally erode during polishing processing to form effective pores or voids in the CMP pad. Non-limiting examples include graphite particles and/or agglomerates. As noted herein, the CMP pad can optionally include a variety of additives, including abrasive particles. The working surface of the CMP pad can be contacted to a wafer to be polished. The method can additionally include introducing a chemical polishing agent on at least a portion of the working surface and frictionally eroding the graphite during the polishing process by operating the CMP pad against the wafer. Such erosion can be sufficient to form effective pores in the CMP pad.

As with the case of graphite as a second material, the second material can be configured to provide one or more additional benefits to the CMP processing upon erosion. For example, the second material can be configured to act as a lubricant upon erosion during processing. Lubrication can boost the polishing rate without causing damage to a wafer. Generally, the liquid polishing agent provides a lubricating function during the CMP polishing, in addition to the chemical polishing function. By utilizing a second material that can provide a lubricating effect, on the working surface of the CMP pad during polishing events or processes, the amount of liquid polishing agent can be reduced, or is not limited to quantities based on the need for the liquid polishing agent to provide the sole lubrication function to the working surface of a CMP pad. Non-limiting examples of materials that can provide a lubricating effect include graphite and silver. In a specific embodiment, a method of lubricating a CMP pad and/or wafer during a CMP event can include impregnating a first material having a first resistance to frictional erosion with a second material having resistance to frictional erosion that is less than that of the first material to form a CMP pad having two materials with different frictional erosion resistances. The second material can be configured to act as a lubricant upon erosion. The method can further include contacting a working surface of the CMP pad to a wafer to be polished and frictionally eroding the second material during the polishing process by operating the pad against the wafer. The second material can migrate to or remain on the working surface of the CMP pad and function as a lubricant.

In another example, the second material can be configured to act as a coolant upon erosion. Graphite is a non-limiting example of a second material that can be configured to act as a coolant upon erosion. The properties of graphite can vary depending on the degree of graphitization. For example, poorly graphitized graphite may not conduct heat very well, while graphite having a high degree of graphitization acts as an effective heat spreader. The thermal conductivity of graphite is generally better than that of copper along graphene planes. Conversely, the thermal conductivity of graphite perpendicular to graphene planes is comparable to that of insulating materials. By the nature of graphite, the graphene planes are easily shuffled under stress, and as such, heat generally will not accumulate. The thermal conductivity of graphite can be altered by including interclating atoms in the graphite. Interclating atoms increase the conductivity of the graphite across the graphite planes. Fore example, foreign, e.g. non-carbon, atoms can intercalate graphite and make the graphite swell. As such, the foreign atoms are situated between the graphite planes. Any foreign atom that can increase the conductivity can be used, in particular sulfur atoms, potassium atoms, nitrogen atoms, oxygen atoms, metal ions, and mixtures of atoms. A non-limiting example of interclating graphite is to boil graphite in nitric acid. By so doing, nitrogen and oxygen can intercalate graphene planes, thus making the graphite a much better conductor across plane, than the graphite without interclation. As mentioned, when graphite includes interclated atoms, it tends to swell. In such cases, the graphite planes can be spaced a greater distance apart and still be considered to be highly graphitized.

Although graphite is often utilized herein in many embodiments, it should be noted that the presently-disclosed CMP pads and methods are not limited to graphite. Any material capable of functioning as disclosed herein can be used effectively. Additional non-limiting examples include $MoS_2$, which can provide lubrication upon erosion, and talc, which can also provide lubrication although the effectiveness of the lubrication may depend at least partially upon particle size being an appropriate size and/or uniform in size (e.g. 10 microns).

As polishing processes tend to generate great amounts of friction-based heat, there is natural concern for the quality and potential damage of materials involved. Particularly, the heat generated by CMP processing should not damage the materials of a wafer, nor would it be acceptable for the materials of a CMP pad (e.g. polymers such as polyurethane) to be damaged by the heat produced during processing. Many polymers are prone to melt at high temperatures. CMP polishing has a tendency to produce hot spots at the contact point of the CMP pad to the wafer. As such, polishing parameters must account for the heat generated during processing, particularly at contact spots, and be selected and/or monitored so as to prevent overheating. Utilizing second materials configured to remain on the working surface and act as a lubricant upon erosion can reduce the occurrence of heat-related failures of the polishing process, and can allow a wider range of parameters that can be used in polishing without experiencing overheating. Graphite is a non-limiting example of a second material that can be configured to provide a coolant effect upon erosion.

There are a variety of configurations for impregnating and placement of the second material within the first material. The second material may be homogeneous throughout the first material, homogeneous throughout portions of the CMP pad, present only in certain locations, specifically concentrated at certain points, uniformly spaced along various axes or throughout the CMP pad, or any other predetermined or preselected configuration or pattern that may be considered desirable, useful, or advantageous. The location and quantity of second material need only be such that it is sufficient to form pores in the CMP pad upon frictional erosion. Specific configurations would vary according to the materials used to manufacture the CMP pad, desired effective porosity, desired pore erosion rate, the material to be polished, projected parameters of use, other pad characteristics such as, e.g., ability to carry electrical bias, etc., as would be apparent to one of ordinary skill in the art. The second material may be impregnated in the first material in any manner known in the art. Likewise, selection of materials may be based on a variety of factors including, e.g., relative particle density, ease of use of material both in forming the CMP pad and in using the CMP pad, cost, etc.

In one embodiment, the second material may be evenly dispersed throughout the CMP pad and/or evenly dispersed throughout the first material. The second material may also be concentrated towards the working surface. In one embodiment, the second material may be present on the working surface of the CMP pad. In another variation, the second material may be uniformly spaced on the working surface. In CMP pads configured to be dressed over time to form new or sharpened asperities, the second material can be evenly distributed throughout the anticipated depth of use of the CMP pad such that each created working surface as formed during dressing, would include substantially similar amounts and/or distribution of a second material along the working surface.

A particular concern in forming a CMP pad of a first and second material is the interaction and ease of dispersion of the materials. As such, it may be useful to select a first material and a second material having similar densities. As a non-limiting example, graphite and variety of polymeric materials such as polyurethane have similar densities. As such, graphite can be dispersed more uniformly in materials such as polymer, due to the similar density and similar chemistry, as compared to other materials, such as, e.g., tin. Such reasoning can apply to selection of other first and second materials.

The second material should be capable of being impregnated in the first material. Additionally, the second material should be configured such that it will form pores upon frictional erosion. Second materials in the form of particulates and/or agglomerates are particularly useful for such use. In one aspect, particulates of the second material can be nanometer size. In another aspect, the particles of the second material can be micron sized or larger. In a specific embodiment, the particles or agglomerates can be from about 1 to about 100 microns in size.

The materials and optional additives can be present in the CMP pad in ranges that provide the noted qualities. Specifically, a second material is impregnated in a first material. The first material can, in one aspect, be the primary material in the CMP pad, in that it is the material present in the greatest concentration in the CMP pad. In one aspect, the first material can be present in the CMP pad in an amount from about 50 vol % to about 99.9 vol %. Conversely, the second material can be present in any amount that provides for properly configuring the material for frictional erosion. In a specific embodiment, the second material can be present in an amount from about 0.1 vol % to about 49.9 vol %. In further embodiments, the second material can be present in amounts less than about 30 vol %, 20 vol %, 10 vol %, or 5 vol %. Where the second material is a conductive material, the CMP pad may be utilized as an ECMP, or electrical CMP. In such cases, the second material should be present in the CMP pad in an amount sufficient to allow the CMP pad to carry an electrical bias. Alternatively, conductive materials may be used as the second material and may be configured, based on amounts, additives, and/or placement, so as to not allow the CMP pad to carry an electrical bias. In one such embodiment, graphite, as the second material having conductive properties, can be present in an amount of less than about 30 vol %. In a further embodiment, graphite can be present in an amount of less than about 20 vol %, or less than about 10 vol %. In each case, the graphite can be configured (including selection of degree of graphitization, location and dispersement in the first material, and location and dispersement within the CMP pad as a whole), to restrict or limit networking, and thus limiting or preventing the pad from being conductive.

As discussed, additives can be present in the CMP pad. Additives can be utilized in the CMP pad for a variety of reasons. Such additives can be present in any amount that would be apparent, based on particular additive and purpose of additive, to one of ordinary skill in the art. In a specific embodiment, an additive can be included in the CMP pad in an amount of from about 0.1 vol % to about 50 vol %. In another embodiment, a plurality of additives can be included in the CMP pad.

Various methods of forming a CMP pad including a first material having a second material impregnated therein would be apparent to one of ordinary skill in the art. Such may be particularly useful, wherein homogeneous dispersement is desired, which likely requires that the second material be uniformly dispersed in the carrier matrix (comprising or consisting essentially of the first material). In some cases, it may be useful to treat one or both materials, and/or to utilize additives, to form the desired CMP pad. Such treatment can allow the wetting of the pad material. As a non-limiting example, graphite or another material can be treated to make the surface of the graphite particles hydrophobic (e.g., with hydrogen or chlorine termination) prior to dispersing the particles in polyurethane which can improve the overall dispersion of graphite in the polyurethane. Hydrophobic graphite and other materials (as from hydrogenation) generally is resistant to dispersement in an oxide medium, however, is relatively easy to disperse in organic materials. Generally, hydrogenation can be performed by heating (e.g. up to about 1000° C.) the second material powder, such as graphite, with hydrogen in a partial vacuum. Hydrogenation can also purify a second material, such as graphite, by removing oxygen and nitrogen. For example, if graphite is treated with fluorine, it is more hydrophobic and the etching of graphite is more pronounced. On the other hand, if graphite is boiled in acid, e.g. hydrosulfuric or nitric acid, the surface absorption of sulfur, nitrogen, and/or oxygen, will make graphite hydrophilic. In such case, only a water-based medium can disperse the graphite with relative ease. Furthermore, such CMP pads can be substantially solid, e.g. having substantially no voids in the CMP pad, or can include pores. As technology and related methods provide, the distribution of particles can be similar to patterned placement of the second material in the first material.

To aid in the processing, a liquid polishing agent may be added to the working surface of the CMP pad. The liquid polishing agent may include an electrolyte. In a configuration, the working surface of the CMP pad may be fully or partially submerged in a liquid polishing agent. Non-limiting examples of electrolytes that may be used include sulfuric acid, phosphoric acid, amino acid, organic amine, phthalic acid, organic carbolic acid, picolinic acid, and combinations thereof. The liquid polishing agent may, in one aspect, consist substantially of water. For example, water may be, in one embodiment, a preferred liquid polishing agent wherein abrasive particles (e.g. abrasives, superabrasives, nano-abrasives, diamond, etc., and mixtures thereof) are impregnated in the CMP pad. Optionally, abrasive particles may be included in the liquid polishing agent. As part of the selection of materials involved in configuring the second material for frictional erosion, the anticipated liquid polishing agent, or lack thereof, may be taken into account. Further, the liquid polishing agent may be selected and supplied to the working surface of the CMP pad so as to provide an increased or decreased rate of frictional erosion of the second material.

The polishing tools created through the disclosed methods may have multiple and various uses beyond use as CMP pads. As such, the scope of use of the tools created according to the disclosed methodologies not be limited to a particular work piece or polishing operation, but that such scope may include any type of polishing or abrading for which these tools and techniques would be useful. Examples of work pieces may include, without limitation, wafers, LEDs, laser diodes, mirrors, lenses, memory storage surfaces, integrated circuits or any other structures containing conductive and/or dielectric structures, quartz, glass, metals, semiconductors, etc. Additionally, the range of detail of polishing may vary depending on the material being polished and the desired application of such material.

The second material and/or CMP processing system can be configured for erosion of the second material at a desired rate. Such rate can be generally stated (i.e. slow erosion, fast erosion), can be quantified, or can be defined based on a similar CMP pad not having the second material. Although any erosion rate can be utilized by the present system and method, in one aspect, the second material can be configured to erode during the first 1/10 of the average life of a comparable CMP pad devoid of the second material. In another embodiment, the second material can be configured to erode consistently or inconsistently during the first ½ of the average life of a comparable CMP pad devoid of the second material. Further, in one aspect, the second material can erode under CMP processing conditions at a rate from about 1 to about 100 times faster than the first material. In a further aspect, the second material can erode under CMP processing conditions at a rate from about 2 to about 50 times faster than the first material. In another embodiment, the second material can erode at a rate greater than or equal to about 5 times faster than the first material. In a further embodiment, the second material can erode at a rate greater than 10 times faster than the first material. Such CMP processing conditions can be based on one or both of standard CMP processing conditions, including liquid polishing agent, or on anticipated CMP processing conditions.

By utilizing the CMP pads and associated methods disclosed herein, CMP processing can be improved. Pores can be formed in-situ, which can provide chemical polishing agent retention, which improves the polishing process. The pores are discrete and generally prohibit loss of chemical polishing agent through the CMP pad. Displaced material can provide additional benefits to the CMP processing such as, e.g., lubrication, and coolant effects. Additionally, CMP pads formed accordingly can reduce run-to-run variation, having more consistent pore sizes and pore locations, as compared to current CMP pads.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape,

What is claimed is:

1. A method of creating pores in a CMP pad in-situ during a CMP polishing event, comprising:

impregnating a first material having a first resistance to frictional erosion with a second material having resistance to frictional erosion that is less than that of the first material to form a CMP pad having two materials with different frictional erosion resistances, wherein the second material is impregnated into the first material in an agglomerated form;

contacting a working surface of the CMP pad to a wafer to be polished; and frictionally eroding the second material during the polishing process by operating the pad against the wafer.

2. The method of claim 1, wherein both the first and second materials are polymeric materials.

3. The method of claim 1, wherein the first material is a polymeric material and the second material is a non-polymeric material.

4. The method of claim 1, wherein the first material is a polyurethane material and the second material is a carbon material.

5. The method of claim 4, wherein the carbon material is graphite.

6. The method of claim 5, wherein the carbon material has a high degree of graphitization.

7. The method of claim 1, wherein both the first and second materials are non-polymeric materials.

8. The method of claim 1, wherein the second material erodes into flakes of less than about 20 microns.

9. The method of claim 8, wherein the second material provides lubrication for the CMP polishing event as it frictionally erodes.

10. The method of claim 1, wherein the pores formed hold liquid polishing materials once created.

11. A method of creating effective pores in a CMP pad in-situ during a CMP polishing event, comprising:

impregnating a polyurethane material with graphite particles or agglomerates to form a CMP pad;

contacting a working surface of the CMP pad to a wafer to be polished;

introducing a chemical polishing agent on at least a portion of the working surface; and frictionally eroding the graphite during the polishing process by operating the CMP pad against the wafer, such that the graphite erosion creates effective pores in the CMP pad.

12. A tool for polishing a wafer, comprising:

a first material suitable for forming a CMP pad and having a first resistance to frictional erosion, said first material forming a portion of the CMP pad;

a second material dispersed in the first material, said second material being in an agglomerated form and having a second resistance to frictional erosion that is less than that of the first material and configured to selectively erode based on differing resistance to frictional erosion, upon frictional contact with the wafer such that the erosion leaves effective pore voids in the solid substrate.

13. The tool of claim 12, wherein both the first and second materials are polymeric materials.

14. The tool of claim 12, wherein the first material is a polymeric material and the second material is a non-polymeric material.

15. The tool of claim 12, wherein the first material is a polyurethane material and the second material is a carbon material.

16. The tool of claim 15, wherein the carbon material is graphite.

17. The tool of claim 16, wherein the carbon material has a high degree of graphitization.

18. The tool of claim 17, wherein the graphite is included in the CMP pad in a volume of from about 0.1 vol % to about 20 vol %.

19. The tool of claim 12, wherein both the first and second materials are non-polymeric materials.

20. The tool of claim 1, wherein the second material is dispersed in the first material in a predetermined configuration.

* * * * *